United States Patent [19]

Watanabe et al.

[11] Patent Number: 5,051,778

[45] Date of Patent: Sep. 24, 1991

[54] ELECTROPHOTOGRAPHIC COPYING MACHINE WHICH INTEGRATES COMPONENTS HAVING SUBSTANTIALLY EQUAL SERVICE LIVES INTO RESPECTIVE DETACHABLE UNITS FORMED OF A DEVELOPING UNIT, A PHOTORECEPTOR UNIT AND A TONER CARTRIDGE UNIT

[75] Inventors: Hisao Watanabe; Jiro Fukasawa, both of Yamanashi, Japan

[73] Assignees: Shindengen Electric Manufacturing Co., Ltd., Tokyo; Yamanashi Electronics Co., Ltd., Yamanashi, both of Japan

[21] Appl. No.: 451,137

[22] Filed: Dec. 15, 1989

[30] Foreign Application Priority Data

Dec. 22, 1988 [JP] Japan ..... 63-321947

[51] Int. Cl.[5] ..... G03G 15/00

[52] U.S. Cl. ..... 355/200; 355/210

[58] Field of Search ..... 355/200, 210, 245, 260

[56] References Cited

U.S. PATENT DOCUMENTS 3,689,146 9/1972 Ito et al. ..... 355/235

3,883,242 5/1975 Takahashi et al. ..... 355/210

FOREIGN PATENT DOCUMENTS 62-159157 7/1987 Japan .

*Primary Examiner*—R. L. Moses

*Attorney, Agent, or Firm*—Stevens, Davis, Miller & Mosher

[57] ABSTRACT

An electrophotographic apparatus has its electrophotographic component parts divided into three units consisting essentially of a developing unit A, a photoreceptor unit B and a toner cartridge unit C. Each of the units is capable of being detached from and reattached to the main body of the apparatus while maintaining the required relative positions. The service lives of the units are set in such a manner that the ratio therebetween is represented as a ratio between integers, and the relationship therebetween in magnitude satisfies the relationship of the service life of the developing unit A ≧ the service life of the photoreceptor unit B ≧ the service life of the toner cartridge unit C. Thus, the apparatus enables its maintenance to be performed easily and economically without requiring any increase in the size and the cost of the electrophotographic mechanisms.

2 Claims, 2 Drawing Sheets

ELECTROPHOTOGRAPHIC COPYING MACHINE WHICH INTEGRATES COMPONENTS HAVING SUBSTANTIALLY EQUAL SERVICE LIVES INTO RESPECTIVE DETACHABLE UNITS FORMED OF A DEVELOPING UNIT, A PHOTORECEPTOR UNIT AND A TONER CARTRIDGE UNIT

BACKGROUND OF THE INVENTION

The present invention relates to an electrophotographic apparatus. More particularly, the present invention relates to an electrophotographic apparatus whose maintenance can be easily and economically performed.

An electrophotographic apparatus includes, as is already known, a photoreceptor which is charged by a charging device, and on which an electrostatic latent image is formed by an exposing device, a developing device which employs toner to form a toner image from the electrostatic latent image, a transferring device for transferring the toner image onto a sheet, a fixing device for fixing the transferred toner image, a cleaning device for cleaning toner remaining on the photoreceptor after the transfer of the toner image, and a charge removing device for removing the charge remaining after the formation of the latent image.

Such component parts constituting an electrophotographic apparatus have their own lives. For instance, the photoreceptor is vulnerable to damage because it is subjected to corona discharge by the charging device, exposed to strong light by the exposing device, and kept in contact with ozone or nitrogen oxides generated by corona discharge or toner. The photoreceptor is also vulnerable to wear because of friction caused by its contacting with a sheet during transfer or with the cleaning device. The developing device may reach the end of its life when, for instance, its charging efficiency is degraded by part of the toner conveyed by a toner conveying carrier adhering to a surface of the carrier, when the carrier itself is worn, or when the device is unable to stably obtain image densities since a developing roller is contaminated with impurities contained in toner and, simultaneously, the device needs a further supply of toner. Also, component parts, such as the cleaning device, which include consumables, such as brushes formed by bundles of fine fiber, have their lives because of this fact.

In order to stably obtain images of high quality, therefore, due attention has to be paid to the checking and the replacement of various component parts, and to the replacement and the supply of consumables, so that each of the component parts is always able to maintain the required level of performance. For this purpose, the conventional practice has been such that various component parts are arranged in such a manner that they can be detached from the main body of the apparatus by detachment mechanisms, and a service person visits the user each time a certain period has passed so as to provide maintenance services such as the checking, the cleaning, and/or the replacement of component parts, and the supply of consumables.

This conventional practice is advantageous in that only the part whose life has ended can be, for instance, replaced. On the other hand, the practice inevitably requires a large number of visits. It also requires a large number of detachment mechanisms for detaching and reattaching component parts from and to the main body of the apparatus, thereby complicating the entire apparatus. In addition, if, during the mounting of component parts, their relative positions are distorted, this leads to the risk of the production of images of good quality being hindered. In order to avoid this risk, the mounting operation must be performed precisely and carefully, thereby making the operation one which is complicated and which requires skill and time. Another disadvantage is that since component parts are more or less contaminated by toner, when they are being detached or reattached, this inevitably results in the area surrounding the apparatus or clothing worn by people becoming contaminated.

A means has been proposed, therefore, to eliminate these disadvantages. According to this proposal, the main parts in the periphery of the photoreceptor, which include the developing device, the charging device and the cleaning device, and which are vulnerable to damage or wear, are arranged in such a manner that they can be detached from and reattached to the main body of the apparatus while they form a completely integral structure. When this structure is replaced, operations such as the replacement of the photoreceptor, the cleaning of the charging device or the like, the replacement of the cleaning device, the disposal of toner removed from the surface of the photoreceptor, and the supply of toner can be performed all at one time.

With this means, therefore, the maintenance operation is simplified. In addition, there is no risk of the area surrounding the apparatus becoming contaminated, while easy maintenance service is made possible. However, a problem arises in that the shortest of the service lives of these component parts integrated in the structure determines the life of the entire structure. For example, if the service life of an organic photoconductive type photoreceptor reaches an end after the production of about 50 thousand printed sheets, the associated developing device, which is, when the service life of the photoreceptor ends, still capable of producing 150 thousand sheets during the rest of its life, must also be abandoned and replaced. This results in high maintenance cost. In addition, the amount of toner initially stored in the integral structure must be great enough to comply with the number of sheets that the associated component part, e.g., the photoreceptor, is capable of producing throughout its service life. If such a great amount of toner is stored, the toner itself may absorb moisture, or blocking due to heat may occur, thereby leading to the risk of image quality degradation. In order to avoid this risk, the mechanism for stirring toner, the mechanism for conveying toner, etc. have to be made large and complicated.

SUMMARY OF THE INVENTION

The present invention has been accomplished to overcome the above-described problems of the prior art. It is an object of the present invention to provide an electrophotographic apparatus which allows its maintenance to be performed easily and economically without requiring any increase in the size and the cost of the electrophotographic mechanisms.

In order to achieve the above-stated object, an electrophotographic apparatus according to the present invention comprises: a main body; and electrophotographic mechanisms divided into three units consisting essentially of a developing unit A, a photoreceptor unit B and a toner cartridge unit C. Each of the units is capable of being detached from and reattached to the main body. The materials forming each of the units are selected in such a manner that the ratio between the service lives of the units is represented as a ratio between integers, and the relationship between the service lives of the units satisfies the relationship of the service life of the developing unit A≧the service life of the photoreceptor unit B≧the service life of the toner cartridge unit C.

DESCRIPTION OF THE PREFERRED EMBODIMENT

The present invention will now be described in detail with respect to an embodiment thereof.

Figure 1:
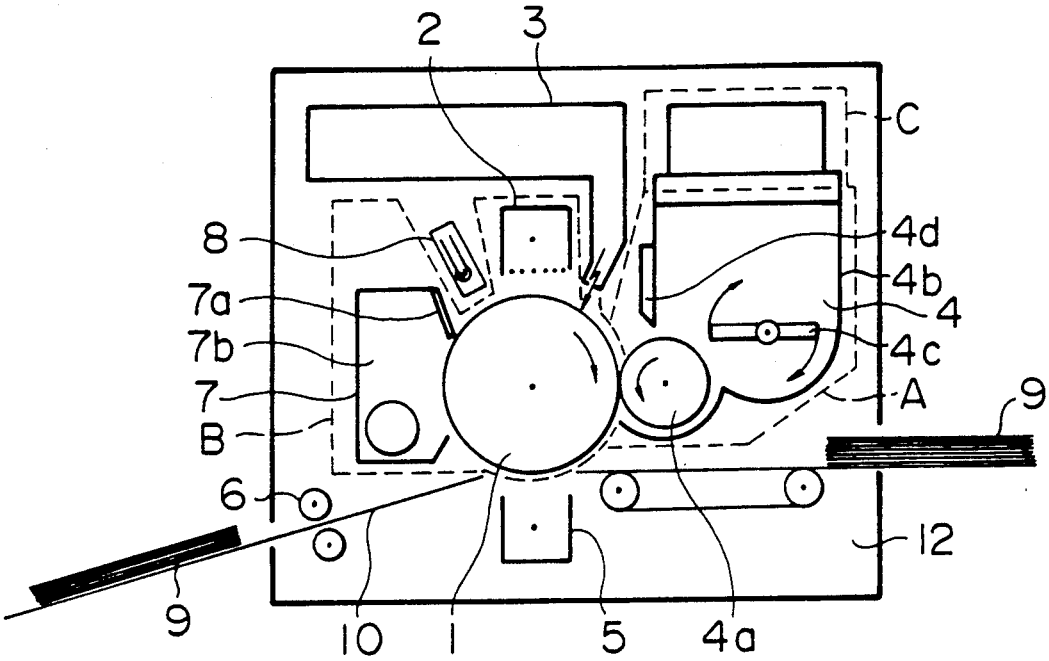
FIG. 1 is a view illustrating an electrophotographic apparatus according to one embodiment of the present invention.

An electrophotographic apparatus which is an embodiment of the present invention includes, as shown in FIG. 1, a photosensitive drum 1, a charging device 2 employing a scorotron, an exposing device 3 employing a laser source, a developing device 4 having a magnetic brush 4*a* carrying toner thereon, a toner storing case 4*b*, a toner stirring mechanism 4*c*, and a doctor blade 4*d* for limiting the thickness of toner on the magnetic brush 4*a*, a transferring device 5 employing a corotron, a fixing device 6 employing heating rolls, a cleaning device 7 having a blade 7*a*, and a toner disposal case 7*b*, a charge removing device 8 employing an LED, and a passage 10 through which sheets 9 are conveyed.

One of the main features of the present invention is that, in the electrophotographic apparatus having the above-described construction, the exposing device 3, the transferring device 5 and the charge removing device 8 are excluded from the category of possible objects of replacement because the above-mentioned devices are component parts having considerably longer lives than others, and requiring a smaller number of times of replacement, checking, or cleaning than others, which allow their cleaning to be performed whenever such is suitable, while they remain fixed to a main body 12 of the apparatus.

Figure 2:
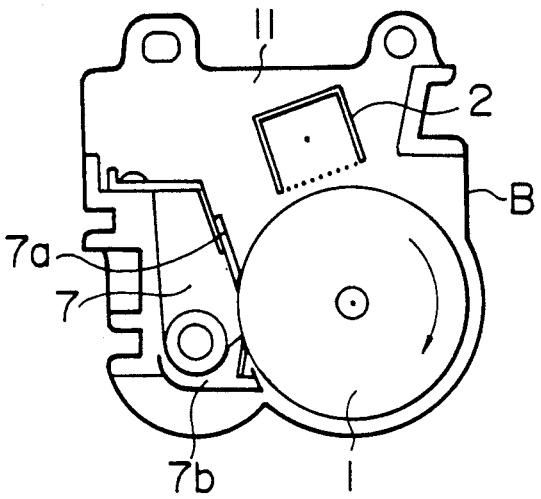
FIGS. 2, 3, 4A and 4B are views showing the structure of various units of the apparatus.

Among the remaining component parts, the photosensitive drum 1, the charging device 2 and the cleaning device 7, which have shorter lives than the above-described exposing device 3, etc., are integrated with a mounting plate 11 as arranged thereon in the required manner, as shown in FIG. 2, so as to form a photoreceptor unit B. The thus formed unit B is fixed to the main body 12 of the apparatus in such a manner as to allow the detachment and reattachment of the unit B while the component parts within the unit B maintain a predetermined relationship in position with such component parts as the exposing device 3, the fixing device 6, the charge removing device 8, and the sheet conveyance passage 10 which remain fixed to the main body 12.

Figure 3:
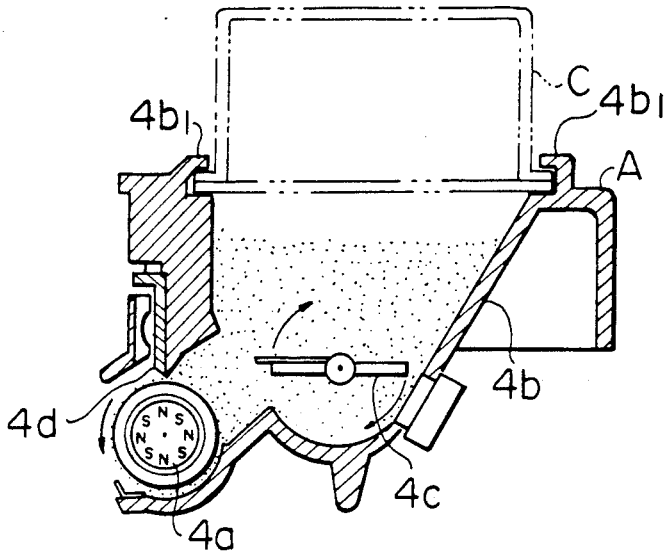

The still remaining component parts are divided into two further units in the following manner. As shown in FIG. 3, the developing device 4 having a longer life than the photosensitive drum 1 is formed as a developing unit A including the magnetic brush 4*a*, the doctor blade 4*d*, the toner storing case 4*b*, and the toner stirring mechanism 4*c*. Also, a toner cartridge unit C for supplying toner into the toner storing case 4*b* is formed, as shown in FIG. 3.

The developing unit A is formed in such a manner that it can be detached from and reattached to the main body 12 of the apparatus while maintaining a predetermined positional relationship with the photosensitive drum 1 of the photoreceptor unit B, as shown in FIG. 1.

Figure 4A:
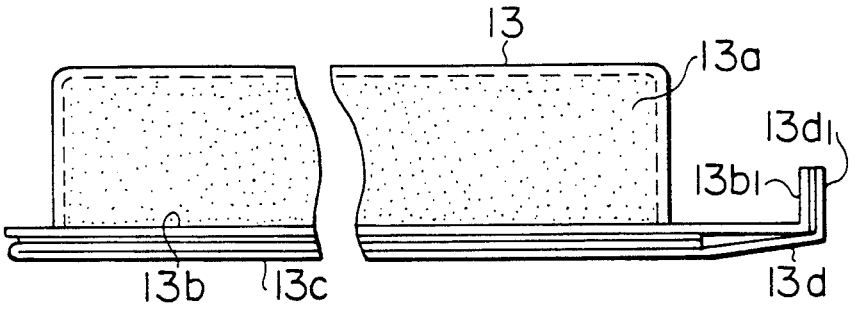
Figure 4B:
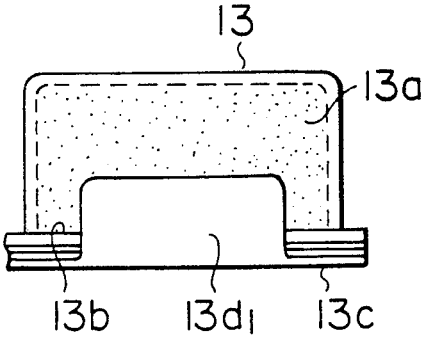

The cartridge unit C may have a construction such as that shown in FIGS. 4A and 4B. Toner 13*a* is charged into a case 13 having a flange 13*b* around its opening. A sealing film is bent into two layers 13*c* and 13*d*. The layer 13*c* is bonded to the flange 13*b* by application of heat so as to tightly seal the opening of the case 13. The layer 13*d* is not bonded to the flange 13*b*, except that its end portion 13*dl* is bonded to a bent extension 13*bl* of the flange 13*b*. As indicated by two-dot-chain lines in FIG. 3, the toner cartridge unit C is mounted on the developing unit A by inserting the flange 13*b* of the case 13 into an engagement groove 4*bl* formed in an upper end portion of the toner storing case 4*b* of the unit A. Thereafter, when the bent extension 13*bl* of the flange 13*b* is broken off and pulled, the seal formed by the sealing film layer 13*c* on the case 13 is broken, thereby opening the case 13, and letting the toner 13*a* drop into the toner storing case 4*b* of the developing unit A.

Another important feature of the present invention will be described.

In general, the service life of the developing unit A can be easily set by selecting the combination of, e.g., the material to be used to form the sleeve, and the materials and the configuration to be used to form the toner stirring mechanism 4*c*. It is usually possible to set the service life of the developing unit A at a value approximately corresponding to the production of 30 to 200 thousand printed sheets.

The service life of the photoreceptor unit B including the photosensitive drum 1 can be set by selecting the materials to be used to form the photosensitive drum 1. If the drum 1 has a photoconductive layer of an organic photoconductor, the service life of the unit B usually corresponds to the production of about 3 to 50 thousand sheets. In the case of a selenium photoconductor, the use of an SeTe-based photoconductor usually allows the service life to correspond to the production of 40 to 100 thousand sheets, whereas the use of an SeAs-based or a-Si-based photoconductor or the addition of a protective film on the surface allows the service life to correspond to the production of at least 100 thousand sheets.

As described before, if the amount of toner supplied at one time from the case 13 is excessively great, this makes the entire developing device 4 large, while involving the risk of image quality degradation due to moisture absorption by toner itself or blocking caused by heat. For this reason, it is preferred that the amount of toner supplied at one time should correspond the production of a moderate number of printed sheets approximately ranging from 1 to 5 thousand. In this way, fresh toner can be supplied and good image quality can be assured.

In view of the foregoing, according to the present invention, the respective service lives of the units A, B and C are set in the following manner. The number of printed sheets producible immediately after one replacement of the toner cartridge unit C, hence, the service life of the unit C is used as the reference, and the service life of each of the developing unit A and the photoreceptor unit B is set using the reference. Specifically, the setting is such that the relationship between the service lives of the units A, B and C are represented as a ratio between integers, and that relationship satisfies the relationship of the service life of the developing unit A≧the service life of the photoreceptor unit B≧the service life of the toner cartridge unit C.

Some examples of this setting are shown in Table 1. In this table, Example 1 is the case of a printer used in a facsimile machine. The developing unit A of the printer includes a sleeve formed of SUS, and bearings disposed between the rotary portions of the sleeve and the magnetic roller. The number of printed sheets which the developing unit A is capable of producing is set at 120,000. The photoreceptor unit B of the printer includes an organic photoconductive drum as the photosensitive drum. The number of printed sheets producible by the unit B is set, on the basis of the materials and the configuration of the component parts within the unit B, at 12,000. In this example, the service lives of the units C, B and A are set in such a manner that the ratio therebetween is represented the ratio between integers of 1:4:40.

TABLE 1

| | UNIT | | |
|---|---|---|---|
| EXAMPLE | DEVELOPING UNIT A | PHOTO-RECEPTOR UNIT B | TONER CARTRIDGE UNIT C |
| 1 | 120,000 (40) | 12,000 (4) | 3,000 (1) |
| 2 | 60,000 (20) | 15,000 (5) | 3,000 (1) |
| 3 | 150,000 (30) | 30,000 (6) | 5,000 (1) |
| 4 | 200,000 (40) | 100,000 (20) | 5,000 (1) |

Shown in Table 1 are approximate numbers of sheets, with numbers in parentheses expressing integers in ratios.

Example 2 shows the case where the above-described setting is applied to a laser printer. The developing unit A of the printer includes a sleeve formed of an aluminum material, while the photoreceptor unit B includes an organic photoconductive drum as the photosensitive drum. The ratio between the service lives of the units C, B and A is set at the ratio between integers of 1:5:20.

Example 3 shows application to a copying machine. The developing unit A of the machine includes a sleeve formed of SUS, and a casing formed of a reinforced material obtained by adding glass to a normally-used ABS resin. Further, a sintered-type integral roller is used as the magnetic roller. The service life of the developing unit A is set to correspond to the production of 150,000 printed sheets. The photoreceptor unit B includes an SeTe-based inorganic photoconductive drum used as the drum, and an integral structure formed by a cleaning device employing a fur brush and a corotron charging device is combined. The number of printed sheets producible by the photoreceptor unit B is set at 30,000. Further, the toner cartridge unit C includes a 1:4 mixture of a magnetic carrier and toner containing 40% of magnetic powder, and the unit C is capable of producing 5,000 printed sheets. Thus, the integer ratio of 1:6:30 is obtained between the lives of the units C, B, and A.

Example 4 is the same as Example 3 except that the developing unit A further includes bearings between the sliding portions of the sleeve and the rotary roller, and between the developing gap rollers, so as to have a longer service life than the unit A in Example 3. Example 4 is also distinguished from Example 3 in that the photoreceptor unit B includes a photosensitive drum in which an SeAs-based material is used, so as to have a longer service life than the unit B in Example 3. The cartridge is the same as that in Example 3. The ratio between the service lives of the units C, B and A is represented as the ratio between integers of 1:20:40.

As has been described above, according to the present invention, the electrophotographic mechanisms of an electrophotographic apparatus are divided into three units consisting of a developing unit A, a photoreceptor unit B and a toner cartridge unit C. The service lives of the respective units are represented as a ratio between integers, and they satisfy the relationship of the service life of the developing unit A≧the service life of the photoreceptor unit B≧the service life of the toner cartridge unit C. Accordingly, in the case of Example 1 shown in Table 1, the numbers of times, these units are replaced during their service lives, are such that while 40 replacements take place with respect to the toner cartridge unit, 10 replacements and 1 replacement take place with respect to the photoreceptor unit and the developing unit, respectively. In contrast with the case where component parts are completely integrated as one structure, and they are detached, reattached or replaced together, the present invention makes it possible to avoid waste which would result in a fact that the replacement of a component part having a short service life inevitably involves the replacement of a second component part having a longer service life. Thus, the present invention improves the economic value of the apparatus. It also avoids waste which would result from the storage of a large amount of toner.

Furthermore, in contrast with the case where each of the component parts is capable of individually detached from and reattached to the main body of the apparatus, the present invention features only three detachable and reattachable portions. This makes it possible to reduce the number of the required detachment/reattachment mechanisms, hence, to simplify the entire apparatus. In addition, since the mounting operation requires only a little consideration to be given to the relative positions of various component parts, the operation can be easily accomplished. Another advantage is that, since the replacement of the units A, B and C can coincide, it is possible to reduce the frequency of periodical maintenance operations. Further, there is little risk of the area surrounding the apparatus being contaminated by toner. In this way, the electrophotographic apparatus of the present invention is capable of thoroughly overcoming the problems encountered with the prior art.

What is claimed is:

1. An electrophotographic copying machine comprising: a main body; and electrophotographic component parts divided into three units consisting essentially of a developing unit A, a photoreceptor unit B and a toner cartridge unit C, wherein the developing unit A includes a magnetic brush, a toner storing case, a toner stirring mechanism and a doctor blade, the photoreceptor unit B includes a photosensitive drum and a charging device, the toner cartridge C includes a toner cartridge, each of said units is capable of being detached from and reattached to said main body while maintaining the required relative positions, the service lives of said units are set in such a manner that the ratio therebetween is represented as a ratio among integers, and the relationship therebetween in magnitude satisfies the relationship of the service life of said developing unit A ≧ the service life of said photoreceptor unit B ≧ the service life of said toner cartridge unit C, and the time for replacement of said developing unit A and said photoreceptor unit B is determined by the frequency of replacement of said toner cartridge unit C and the time for replacement of said developing unit A is further determined by the frequency of replacement of said photo-receptor unit B.

2. An electrophotographic copying machine according to claim 1, wherein the photoreceptor unit B further includes a cleaning device.

* * * * *